US009174711B2

(12) United States Patent
Sivertsen

(10) Patent No.: US 9,174,711 B2
(45) Date of Patent: Nov. 3, 2015

(54) DEVICE AND SYSTEM FOR MANOEUVRING CLEANING APPARATUSES

(75) Inventor: Trond Sivertsen, Stabekk (NO)

(73) Assignee: MPI TROND SIVERTSEN, Stabekk (NO)

( * ) Notice: Subject to any disclaimer, the term of this patent is extended or adjusted under 35 U.S.C. 154(b) by 1053 days.

(21) Appl. No.: 13/003,599

(22) PCT Filed: Jul. 8, 2009

(86) PCT No.: PCT/NO2009/000254

§ 371 (c)(1),
(2), (4) Date: Mar. 14, 2011

(87) PCT Pub. No.: WO2010/005314

PCT Pub. Date: Jan. 14, 2010

(65) Prior Publication Data

US 2011/0162682 A1 Jul. 7, 2011

(30) Foreign Application Priority Data

Jul. 11, 2008 (NO) ..... 20083079

(51) Int. Cl.
*B63B 59/08* (2006.01)
*B63B 59/10* (2006.01)
*B08B 3/02* (2006.01)

(52) U.S. Cl.
CPC ..... *B63B 59/08* (2013.01); *B08B 3/024* (2013.01); *B63B 59/10* (2013.01)

(58) Field of Classification Search
CPC ..... B63B 59/08; B63B 59/10; E04H 4/1654; B08B 3/024
USPC ..... 134/198
See application file for complete search history.

(56) References Cited

U.S. PATENT DOCUMENTS

| | | | | |
|---|---|---|---|---|
| 3,251,331 | A | 5/1966 | Crawford, III | |
| 4,462,328 | A | 7/1984 | Oram | |
| 4,716,849 | A | 1/1988 | Conn et al. | |
| 4,835,809 | A | 6/1989 | Roumagnac | |
| 5,240,443 | A * | 8/1993 | Futaki | 440/38 |

(Continued)

FOREIGN PATENT DOCUMENTS

| | | | |
|---|---|---|---|
| EP | 0131987 | A1 | 1/1985 |
| JP | H08-116826 | A | 5/1996 |

(Continued)

OTHER PUBLICATIONS

PCT/NO2009/000254 International Search Report, Oct. 15, 2009 (5 p.).

(Continued)

*Primary Examiner* — Jason Ko
*Assistant Examiner* — Spencer Bell
(74) *Attorney, Agent, or Firm* — Conley Rose, P.C.

(57) ABSTRACT

Device for maneuvering and propulsion of a cleaning apparatus for removal of marine fouling from marine installations below surface. The device at least includes an induction part adapted to supply a fluid at high pressure, a nozzle with an inlet for supply of the fluid at high pressure, and a tubular body with an induction side and an outlet where said nozzle is arranged close to the induction side. The device also includes a system for cleaning of marine installations where one or more devices for maneuvering and propulsion are used.

13 Claims, 6 Drawing Sheets

(56) References Cited

U.S. PATENT DOCUMENTS

| | | | | |
|---|---|---|---|---|
| 5,802,653 | A | 9/1998 | Roumagnac | |
| 6,502,269 | B1 | 1/2003 | Balchan et al. | |
| 7,971,547 | B1 * | 7/2011 | Hertel et al. | 114/222 |
| 2007/0051392 | A1 | 3/2007 | Andersen et al. | |

FOREIGN PATENT DOCUMENTS

| | | | |
|---|---|---|---|
| JP | 2001276754 | A | 10/2001 |
| NO | 116773 | B | 5/1969 |
| NO | 313746 | B1 | 7/2000 |
| NO | 319207 | B1 | 6/2005 |
| SU | 891496 | A1 | 12/1981 |
| SU | 927641 | A1 | 5/1982 |
| WO | 8202368 | A1 | 7/1982 |

OTHER PUBLICATIONS

Search Report for Norwegian Application No. 20083079, Feb. 9, 2009 (3 p.).

* cited by examiner

DEVICE AND SYSTEM FOR MANOEUVRING CLEANING APPARATUSES

CROSS-REFERENCE TO RELATED APPLICATIONS

This application is a 35 U.S.C. §371 national stage application of PCT/NO2009/000254 filed Jul. 8, 2009, which claims the benefit of Norwegian Application No. 20083079 filed Jul. 11, 2008, both of which are incorporated herein by reference in their entireties for all purposes.

STATEMENT REGARDING FEDERALLY SPONSORED RESEARCH OR DEVELOPMENT

Not applicable.

TECHNICAL FIELD

The present invention relates to a cleaning apparatus for removal of marine fouling from seines and pens below surface at least comprising a device for maneuvering and propulsion of the cleaning apparatus. More particularly each of the at least one device for maneuvering and propulsion comprises an induction part adapted to supply of a fluid at high pressure, a nozzle with an inlet for supply of the fluid at high pressure, and a tubular body with an induction side and an outlet where said nozzle is arranged close to the induction side. The invention also relates to the use of a cleaning apparatus for removal of marine fouling from seines and pens.

BACKGROUND ART

Marine fouling is a problem within all marine activities such as shipping, within the fish farming industry and within the offshore petroleum industry. Within the shipping industry it is a problem with increased friction which increases the fuel consumption and thereby also increases among other the CO2 emissions. Traditionally toxic ship-bottom paints with zinc and lead compounds which have a harmful effect on organisms in the sea. Within the fish farming industry fouling prohibits flow through of water and thereby also reduces the level of oxygen in the seines. On fixed facilities and on oil facilities fouling can obscure constructional weaknesses and fouling may also accelerate fatigue of facilities such as quays, bridge pedestals and the like.

Pens have traditionally been cleaned by divers which have utilized high pressure water jets for removal of unwanted fouling. Vessels and fixed constructions have also to some extent been cleaned by divers with movable equipment for high pressure washing.

A disadvantage with manual removal is the process is slow, and if a routinely cleaning is requested as it is within the fish farming industry this solution becomes both bothersome and resource-demanding. As a consequence of the shortcomings due to these methods for cleaning more sophisticated and automated equipment for removal of marine fouling have been developed.

An example of a device for cleaning of marine installations is disclosed in Ser. No. 19/986,219 (Andorsen); this device comprises a plate like device with a plurality of rotors which is propelled by high pressure water. The device is guided alongside the objects to be cleaned with supplied high pressure so as to propel the rotors. Under optimal flow conditions this solution works out well.

It is a problem with the "rotor-device" for cleaning of marine installations that under not so optimal flow conditions the "rotor-device" is difficult to maneuver additionally it will often be difficult to follow the surface contour of the body to be cleaned. It shall be noted that the outer walls of the pens—fishing nets—not necessarily hangs straight down so that the fishing nets walls are vertical or follows a parable to its bottom, it is rather common that the pens fishing nets caused by flow conditions follows an s-shape towards its bottom. A number of other installations also have such a shaping that utilization of the rotor-device according to Ser. No. 19/986,219 will not render the requested maneuverability.

DISCLOSURE OF INVENTION

It is an object according to the present invention to solve the above mentioned problems.

According to one embodiment it is disclosed a cleaning apparatus for removal of marine fouling from seines and pens below surface at least comprising:

at least one device for maneuvering and propulsion of the cleaning apparatus where each of the at least one device for maneuvering and propulsion comprises;

a high pressure water inlet adapted to supply fluid at high pressure; a nozzle with an inlet for supply of the fluid at high pressure, and a tubular body with a water inlet side and an outlet where said nozzle is arranged close to the water inlet side within the tubular body, and where the nozzle opening points in the direction of the outlet of the tubular body.

The cleaning apparatus further comprises a plate like body provided with one or more rotating cleaning units and that one or more of said devices for maneuvering and propulsion is mounted to the plate like body so that the devices for maneuvering and propulsion has its water inlet side covering an opening in the plate like body whilst the outlet protrudes out from the backside of the plate like body.

According to one aspect of the embodiment it is disclosed a cleaning apparatus where said plate like body has one or more wheels mounted to its front side.

According to yet an aspect the cleaning apparatus is specified in that the at least one device for maneuvering and propulsion of the cleaning apparatus further comprises a funnel-shaped suction part.

In yet an embodiment according to the invention it is disclosed a cleaning apparatus where the at least one device for maneuvering and propulsion of the cleaning apparatus comprises one or more protruding spacers adapted to be fixed to a plate like body, where the protruding spacers preferably is arranged at the circumference to the tubular shaped suction side and where the protruding spacers are parallel to or substantially parallel to the devices' central part.

In another aspect according to the invention it is provided a cleaning apparatus where the at least one device for maneuvering and propulsion of the cleaning apparatus at its tubular outlet is provided with a fixed or rotating end pipe piece which is bent or bendable.

In yet another aspect according to the invention it is provided a cleaning apparatus where the at least one device for maneuvering and propulsion of the cleaning apparatus end piece is rotating and is remotely controllable by an operator.

In yet another aspect according to the invention it is provided a cleaning apparatus where the at least one device for maneuvering and propulsion of the cleaning apparatus at its outlet is provided with one or more adjustable vanes for controlling the outlet flow from the device.

In yet an aspect it is provided a cleaning apparatus according to any of the recited embodiments above where the opening of the at least one device for maneuvering and propulsion of the cleaning apparatus is provided with means adapted to prevent sucking in foreign objects.

It is also disclosed use of a cleaning apparatus according to one or more of the recited embodiments for cleaning of seines and/or pens.

Another aspect of the present invention is to increase the efficiency of cleaning equipment rendering it possible to remove fouling on less accessible places without increase of water pressure to the jet-disc.

Said objects and goals are achieved according to the invention by a cleaning apparatus in accordance to the appended claims. Advantageous embodiments will be apparent from the dependent claims.

BRIEF DESCRIPTION OF DRAWINGS

The invention will now be described in further details with reference to the drawings, in which.

MODE(S) FOR CARRYING OUT THE INVENTION

In the following follows a detailed description of the invention with references to the accompanying drawings. It shall be understood that in the following the meaning of the wording water jet device includes any water jet device fixed or rotating, which when connected to a fluid of high pressure at its inlet will result in a stream at a substantially lower pressure at its outlet and simultaneously with a substantial increase in flow rate. That is, one may talk about a converter that converts a high input pressure with a low flow rate to a low outlet pressure with a large flow rate.

A fundamental principle according to the present invention is that a jet with a large flow rate and relatively low pressure will give substantially increased propulsion in a fluid than a jet with high pressure and correspondingly lower flow rate. This fact is utilized so as to better the maneuverability of sub surface cleaning units according to the present invention. Such a use of water jet devices for maneuvering gives rise to numerous additional advantages beyond better maneuverability, one will for instance use less supplied energy from the high pressure reservoir coupled to the cleansing unit than for traditional systems were high pressure jets with low fluid rates.

Figure 1:
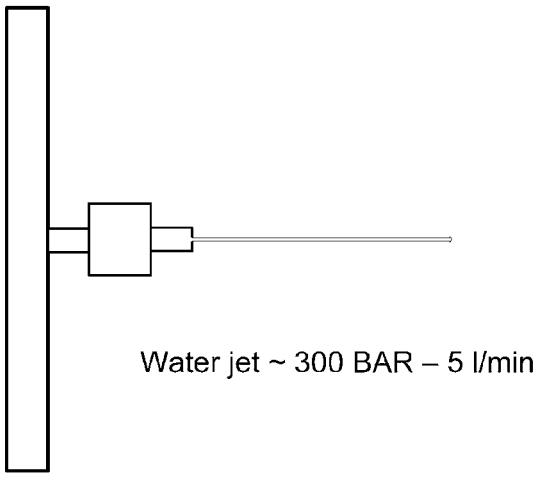
Fig. 1 (PRIOR ART)
FIG. 1 shows a maneuvering body in accordance to the prior art.

FIG. 1 shows an example of a traditional device for maneuvering and propulsion of cleaning apparatuses. Such a device is known to be placed in the centre of rotating cleaning apparatuses i.e. the "rotordevice" for cleaning of marine installations where the rotating cleaning units are propelled by high pressure water jets. The rotating cleaning units are as an example fixed to a framework and/or on a suitable board. Experience and experiments has shown that cleaning apparatuses for sub surface removal of fouling has proved that such traditional devices for maneuvering and propulsion have substantial drawbacks.

As indicated above a high pressure inlet with low flow rate and an outlet with a high flow rate have empirically shown particularly advantageous properties for propulsion and maneuvering. It is essential during cleaning that the cleaning device as such is as close to the object to be cleaned as possible. Hence it will be favorable with such an optimal forward thrust which is achieved according to the present invention. One will then get a cleaning apparatus which follows the surface to be cleaned in an optimal way.

Figure 2:
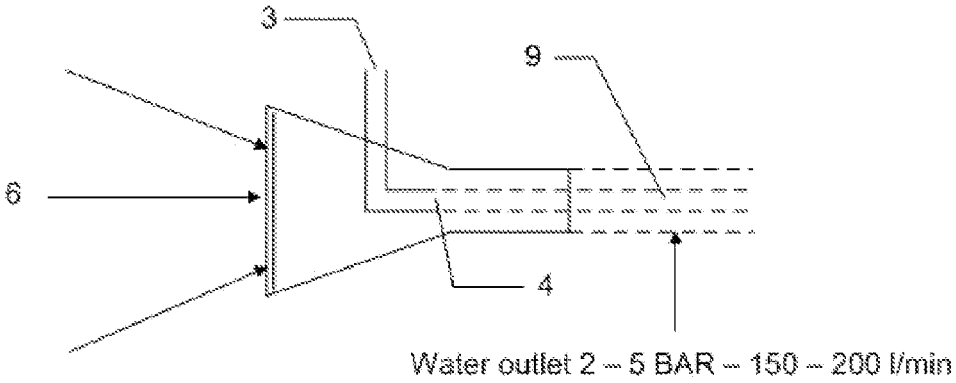
FIG. 2 shows an example of a propulsion and maneuvering body according to one embodiment of the present invention.
Figure 6:
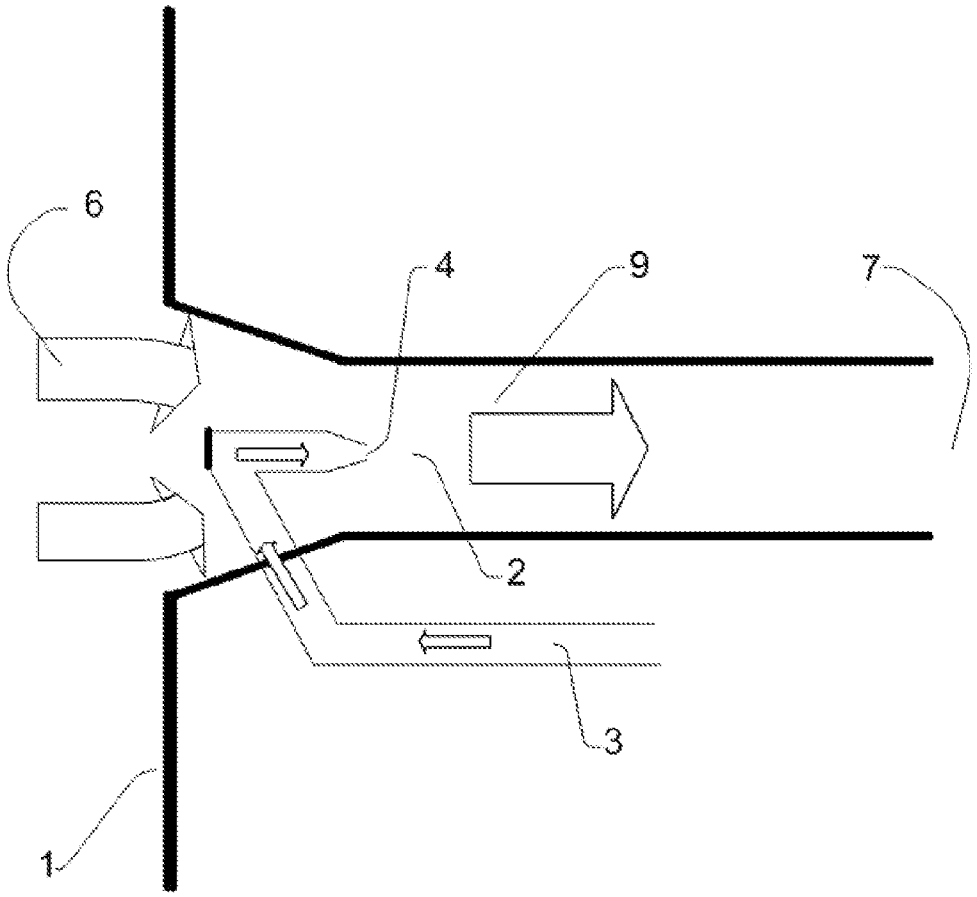
FIG. 6 shows a detailed sketch of a propulsion and maneuvering body according to the present invention.

FIG. 2 depicts in a simple way an example on how in- and outlet flow stream of water is transformed through a water jet device for maneuvering and propulsion according to the present invention. FIG. 6 indicates the manner of operation and configuration in closer detail. The water jet device is here arranged in plane or approximately in plane with a front board 1 for an apparatus for removal of marine fouling from marine installations. Water at a relatively high pressure, e.g. at 150-300 bar is supplied through a high pressure tube to the inlet side 3 of the water jet device. Centrally located in the water jet opening is a nozzle 4 which receives said water from the inlet side 3, this nozzle 4 then pushes water out at a high pressure 2. The design results in a large amount of water 6 (e.g. 150-200 l/min), as compared to the water stream at inlet side 3, is sucked in the water jet devices' opening or inlet 5, the water is directed through the tubular body of the water jet device past the centrally located nozzle 4 and towards the water jet devices' outlet 7. At the water jet devices' outlet 7, one will have a flow of water 9 as a consequence of the water flows 2 and 6.

Figure 7:
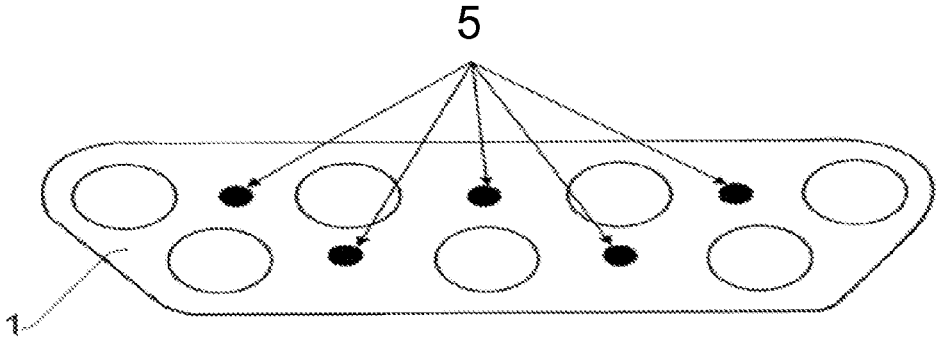
FIG. 7 shows an example of a number of propulsion and maneuvering means according to the present invention fixed to a cleaning apparatus.
Figure 8:
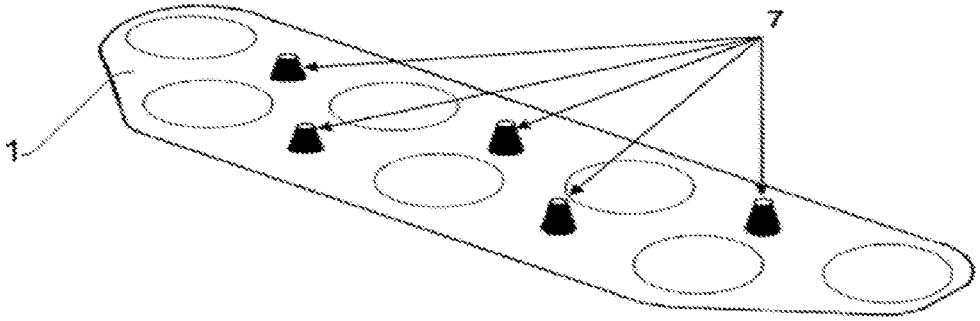
FIG. 8 shows an example of use of a number of propulsion and maneuvering means according to the present invention fixed to a cleaning apparatus seen from the backside of a cleaning apparatus.

A water jet device as described above can be combined with a number of water jet devices which is mounted to a front board for an apparatus for removal of marine fouling from marine installations (FIG. 7, 8). Such a front board 1 will typically be provided with a plurality of rotating cleaning units, as shown in FIGS. 7 and 8, it is indicated having seven rotating cleaning units; however, one shall realize that the number of rotating cleaning units can be two or more. The rotating cleaning units will typically be propelled by high pressure water, preferably from the same high pressure source as the water jet devices. A system comprising a front board 1, two or more rotating cleaning units and at least a water jet device is referred to as "the rotor apparatus" for cleaning of marine installations according to the present invention. A "rotor apparatus" for cleaning of marine installations according to the present invention will, as opposed to a rotor apparatus according to the prior art, have a good stability also under difficult flow conditions, one will have a substantially improved cleaning effect as the "rotor apparatus" for cleaning of marine installations according to the present invention will follow the structure of the objects to be cleaned in a better way than the rotor apparatus according to the prior art. The use of water jet devices for the "rotor apparatus" for cleaning of marine installations according to the present invention is an example of use, as the water jet device obviously can be fixed to other plate like cleaning apparatuses.

The water jet device can be provided with a pivoting and bent end pipe piece at its outlet 7; one will then be able to control the direction of water flows by rotating the end pipe piece. The rotating end pipe piece can be manually rotated or be remotely rotated. As an alternative to a rotating end pipe piece one can imagine having an end pipe piece which is flexible and hence bendable. Further one can imagine that the end pipe piece is provided with a vane for control of water flow or still further with fins on the inside for control of the water flow. Said variants of end pipe pieces may be combined in any suitable way. The flexible solution with possibilities of numerous variants of end pipe pieces will facilitate adaptation of the water jet devices to a great number of cleaning apparatuses with varying design of front boards and still achieve a good stability and good propulsion.

To prevent parts of a seine or other objects to be sucked in with the water flow 6 the opening 5 of the water jet device may be provided with a mesh, a transverse beam, two crossing beams or any other solution that prevents objects to be sucked in with the water flow 6.

A further improvement of the "rotor apparatus" for cleaning marine installations according to the present invention is to mount wheels distributed on the frontal board so as to reduce friction against the surface to be cleaned. The increased propulsion of the "rotor apparatus" for cleaning of marine installations according to the present invention will take advantage of the reduced friction against the base to be cleaned, and it is thus appropriate that the wheels on the "rotor apparatus" is arranged so as to be in contact with the surface to be cleaned. The wheels may be arranged in different directions so that (for a seine washer) it can easily glide over the horizontal and vertical supporting strings on the seines. The wheels can have a width approximately identical to the "rotor apparatus" for cleaning of marine installations according to the present invention. The wheels will then have a diameter preventing them from going through the mesh size of the nets In the following, the present invention will be described with exemplary embodiments.

A First Embodiment of the Invention

Figure 3:
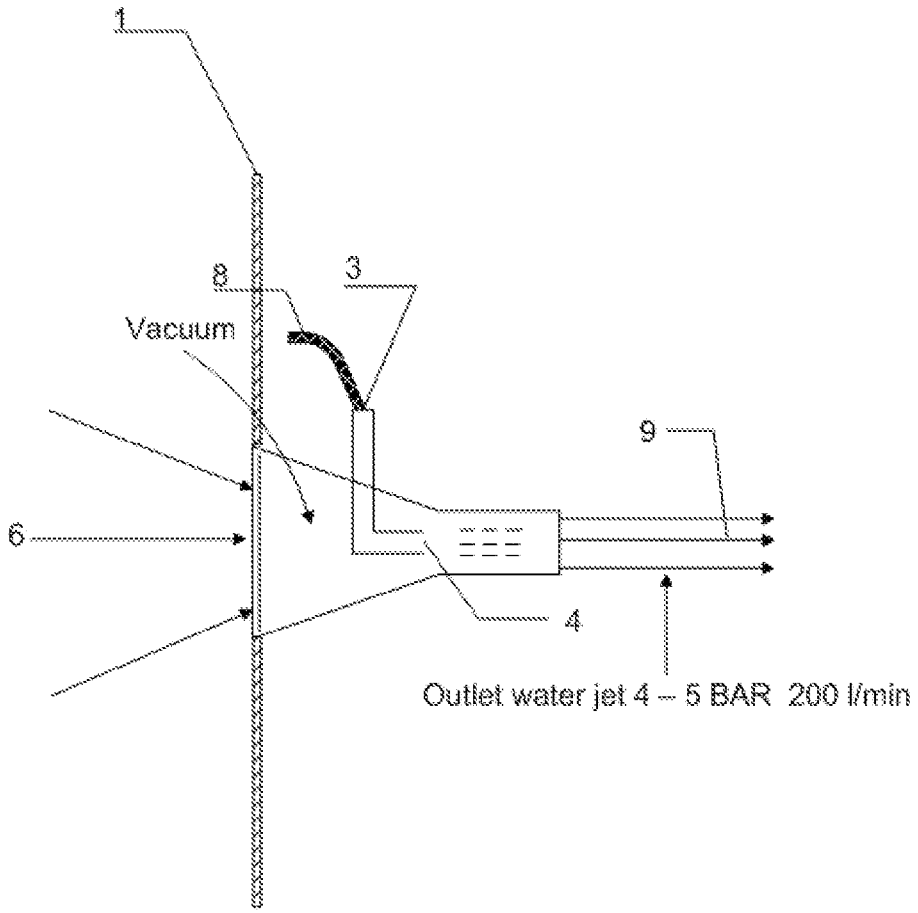
FIG. 3 shows a more detailed example of a propulsion and maneuvering body according to one embodiment of the present invention.

A first embodiment of a system comprising one or more water jet devices will now be described with support in FIG. 3. In FIG. 3 it is depicted a water jet device mounted to a front board 1 and covering an opening in this front board. This water jet device will typically have a design as shown in FIG. 6. A high pressure tube 8 with a water flow of 4-5 l/min at a pressure of approximately 280 bar is supplied to the water jet device via the inlet side 3 and is directed to a centrally located inner nozzle 4. It will then Ube generate an outlet flow 9 out from the water jet device of approximately 200 l/min with a pressure of 4-5 bar.

A Second Embodiment of the Invention

Figure 4:
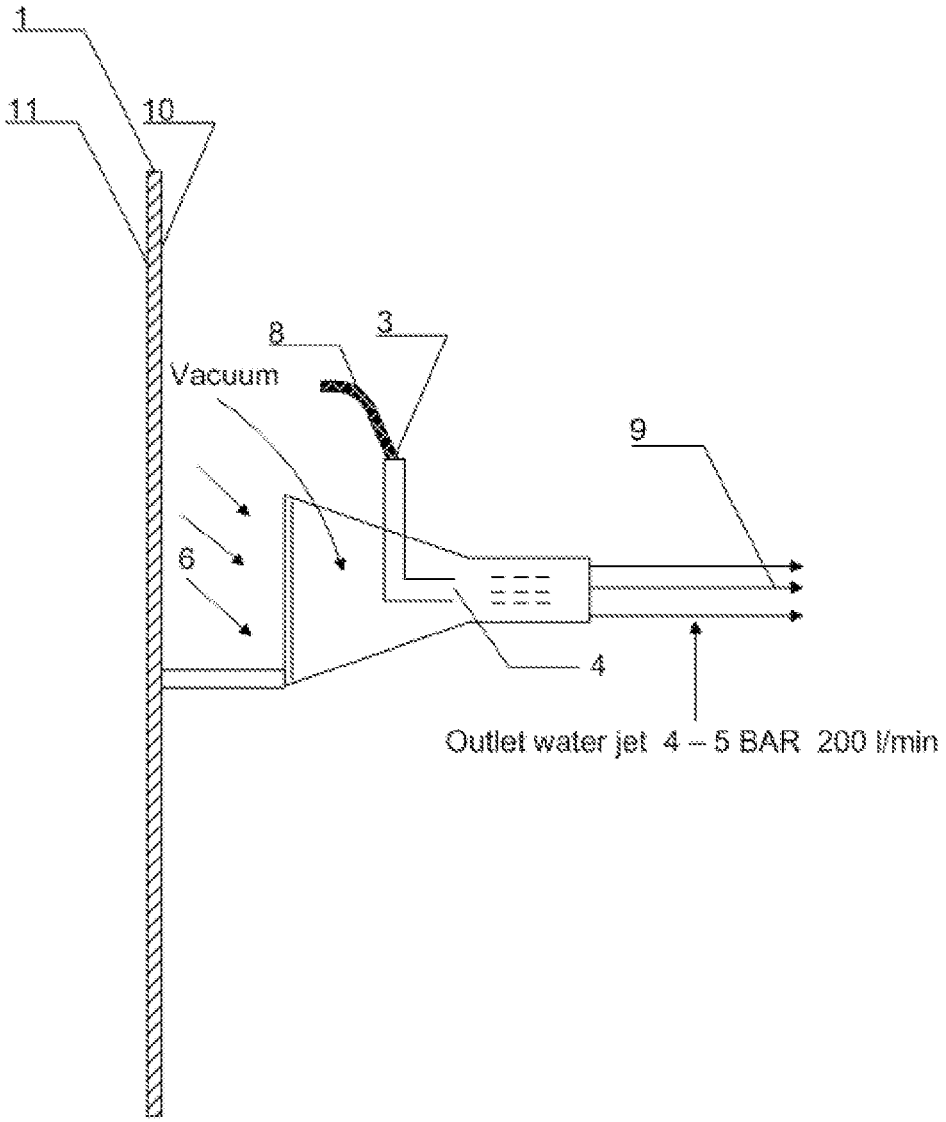
FIG. 4 shows a more detailed example of a propulsion and maneuvering body according to a further embodiment of the present invention.

A second embodiment of a system comprising on or more water jet devices will now be described with support in FIG. 4. In FIG. 4 it is shown a water jet device mounted to a front board with one or more protruding spacers mounted to the backside of said front board. This water jet device will typically have a design as shown in FIG. 6. A high pressure tube with a water flow of 4-5 l/min at a pressure of approximately 280 bar is supplied to the water jet device via the inlet side 3 and is directed to a centrally located inner nozzle. It will then generate an outlet flow 9 out from the water jet device of approximately 200 l/min with a pressure of 4-5 bar. This system will, compared with the first embodiment, be better protected against foreign bodies being sucked into and clogging the water jet devices' inlet, and foreign objects damaging the water jet devices' suction.

A Third Embodiment of the Invention

Figure 5:
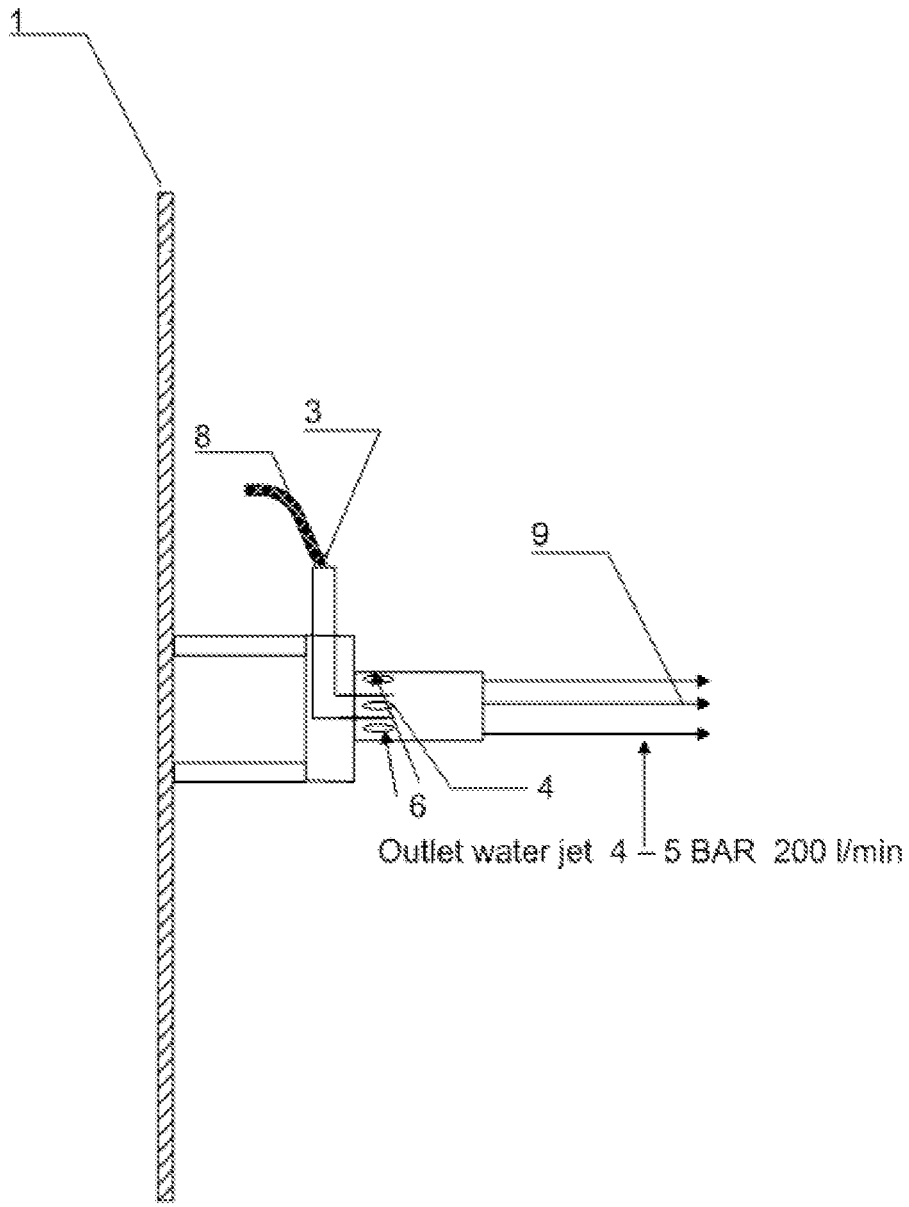
FIG. 5 shows a more detailed example of a propulsion and maneuvering body according to still a further embodiment of the present invention.

A third embodiment of a system comprising one or more water jet devices will now be described with support in FIG. 5. In FIG. 5, it is shown a water jet device mounted to a front board with one or more protruding spacers or a tubular spacer mounted to the backside of said front board. This water jet device will typically have a design as shown in FIG. 6. A high pressure tube 8 with a water flow of 4-5 l/min at a pressure of approximately 280-300 bar is supplied to the water jet device via the inlet side 3 and is directed to a centrally located inner nozzle 4. According to this solution, the inlet 5 of the water jet device is provided with one or more slits which together constitutes the water jet devices' inlet. It will then generate an outlet flow 9 out from the water jet device of approximately 200 l/min with a pressure of 4-5 bar. This system will, compared with the first embodiment, be better protected against foreign bodies being sucked into and clogging the water jet devices' inlet, and foreign objects damaging the water jet devices' suction.

A number of examples of water jet devices, examples of use of water jet devices in systems for cleaning, and methods for regulating the intensity and direction of the water jet devices' outlet have been shown and described. It shall be appreciated that all of the above mentioned devices can be combined mutually so as to provide optimal cleaning apparatuses for marine use. Common to all of the solutions are utilization of one or more water jet devices that when coupled to a high pressure fluid at its inlet will result in a flow with a substantially lower pressure at its outlet and simultaneously with a substantially higher flow rate.

The water jet devices can be utilized on all marine sub surface cleaning apparatuses which can be connected to a high pressure water reservoir.

REFERENCES TO THE DRAWINGS

1 Front Board
2 Outlet stream of the nozzle 4 (high pressure)
3 Water inlet (high pressure)
4 Nozzle of the water jet device 3
5 Inlet of the water jet device
6 Inlet stream of the water jet device
7 Outlet of the water jet device (moderate pressure and high flow rate)
8 High pressure tube
9 Outlet stream of the water jet device
10 Backside
11 Front

The invention claimed is:

1. Pens and seines underwater cleaning apparatus, the cleaning apparatus comprising:

a planar board with a group of rotating cleaning units spaced apart from a group of maneuvering and propulsion devices, the board having a front side and a back side;

wherein each maneuvering and propulsion device of the group is mounted on respective separate apertures in the board and comprises:

a tubular body mounted on the back side of the board and having a water inlet side covering the aperture in the board, an outlet side protruding from the back side of the board, and a nozzle disposed in a funnel shaped area of the tubular body and positioned downstream of the water inlet side, and wherein the nozzle outlet points in the direction of the outlet of the tubular body, the nozzle outlet pointed in a direction substantially perpendicular to the surface of the board, and wherein the nozzle has a high pressure inlet adapted to receive fluid at high pressure and its outlet is adapted to deliver the fluid at high pressure in the direction of the outlet of the tubular body.

2. Cleaning apparatus according to claim 1, wherein said board comprises one or more wheels mounted to its front side, where the front side of the board includes the water inlet side of the tubular body.

3. Cleaning apparatus according to claim 1, wherein each maneuvering and propulsion device of the cleaning apparatus at the outlet of the tubular body comprises a fixed or rotating end pipe piece which is bent or bendable.

4. Cleaning apparatus according to claim 3, wherein each maneuvering and propulsion device of the cleaning apparatus end pipe piece is rotatable and is remotely controllable by an operator.

5. Cleaning apparatus according to claim 1, wherein each maneuvering and propulsion device of the cleaning apparatus at the outlet of the tubular body comprises one or more adjustable vanes for controlling the outlet flow from the device.

6. Cleaning apparatus according to claim 1, wherein the water inlet of the tubular body of each maneuvering and propulsion device of the cleaning apparatus is configured to prevent entry of foreign objects.

7. Pens and seines underwater cleaning apparatus for removal of marine fouling below the water surface, the cleaning apparatus comprising:

a planar board having a plurality of openings, the board having a front side and a back side;

at least one maneuvering and propelling water jet device coupled to the board and configured to cover an opening of the plurality of openings; and at least one rotary cleaning unit coupled to the board and spaced apart from the at least one maneuvering and propelling water jet device;

wherein the water jet device comprises:

a tubular body having an inlet and an outlet and a funnel shaped portion;

a nozzle device having an inlet and an outlet; and a high pressure water inlet;

the nozzle being disposed in the funnel shaped portion of the tubular body, the nozzle inlet being in fluid communication with the high pressure water inlet, and the nozzle outlet is pointed in a direction substantially perpendicular to the surface of the board.

8. The cleaning apparatus of claim 7, wherein the inlet of the tubular body covers one of the plurality of openings in the board, and the outlet of the tubular body protrudes from the back side of the board.

9. The cleaning apparatus of claim 7, wherein the nozzle outlet points in the direction of the outlet of the tubular body.

10. The cleaning apparatus of claim 7, wherein the water jet device comprises one or more protruding spacers adapted to be fixed to the back side of the board, and wherein the protruding spacers are arranged at a circumference of the inlet of the tubular body.

11. The cleaning apparatus of claim 7, wherein the water jet device at the outlet of the tubular body comprises a fixed or rotatable end pipe piece which is bent or bendable.

12. The cleaning apparatus of claim 7, wherein the water jet device at its outlet comprises one or more adjustable vanes for controlling the outlet flow from the device.

13. The cleaning apparatus of claim 7, wherein the inlet of the tubular body is configured to prevent entry of foreign objects.

* * * * *